US009186552B1

(12) United States Patent
Deal

(10) Patent No.: US 9,186,552 B1
(45) Date of Patent: Nov. 17, 2015

(54) MULTIUSE TREADMILL APPARATUS

(71) Applicant: Therese Deal, Bremerton, WA (US)

(72) Inventor: Therese Deal, Bremerton, WA (US)

( * ) Notice: Subject to any disclaimer, the term of this patent is extended or adjusted under 35 U.S.C. 154(b) by 0 days.

(21) Appl. No.: 14/632,171

(22) Filed: Feb. 26, 2015

(51) Int. Cl.
*A63B 22/02* (2006.01)
*A63B 24/00* (2006.01)
*A63B 21/04* (2006.01)

(52) U.S. Cl.
CPC ..... *A63B 24/0087* (2013.01); *A63B 21/04* (2013.01); *A63B 22/02* (2013.01)

(58) Field of Classification Search
USPC ..... 482/51, 54
IPC ..... A63B 22/02,22/0012
See application file for complete search history.

(56) References Cited

U.S. PATENT DOCUMENTS 5,171,196 A * 12/1992 Lynch ..... 482/7
5,368,532 A 11/1994 Farnet
5,527,245 A * 6/1996 Dalebout et al. ..... 482/54
5,830,113 A * 11/1998 Coody et al. ..... 482/54
7,048,676 B1 5/2006 Wu
7,628,737 B2 * 12/2009 Kowallis et al. ..... 482/94
7,846,070 B2 12/2010 Oglesby et al.
2013/0225371 A1 * 8/2013 Harrer et al. ..... 482/8

* cited by examiner

*Primary Examiner* — Glenn Richman
(74) *Attorney, Agent, or Firm* — Crossley Patent Law

(57) ABSTRACT

A multiuse treadmill apparatus including a treadmill, a support structure comprising a right pole and a left pole, a pair of handles, a control panel, a display screen, a plurality of controls, a pair of support frames, a pair of top support bars, and a pair of bottom support bars. A plurality of hooks are continuously disposed. Each of the plurality of hooks has an apex perpendicularly disposed towards the back side of the treadmill. The plurality of hooks are configured to engage a plurality of resistance bands. A pair of weight sensors comprising a right weight sensor and a left weight sensor are centrally disposed within the right deck and the left deck, respectively. The right weight sensor and the left weight sensor are configured to turn the motor off when a minimum weight is downwardly applied to the right deck and the left deck, respectively.

5 Claims, 7 Drawing Sheets

MULTIUSE TREADMILL APPARATUS

BACKGROUND OF THE INVENTION

Various types of treadmills are known in the prior art. However, what has been needed is a multiuse treadmill apparatus comprising a treadmill, a support structure, a ii plurality of hooks that are configured to engage a plurality of resistance bands, a right deck and a left deck that is at least three feet in width, and a pair of weight sensors centrally disposed within the right deck and the left deck on the treadmill. Thus, a user can incorporate upper body resistance training with cardiovascular training in a much more efficient and effective manner. The pair of weight sensors and the wider width of the right deck and the left deck allows a user to incorporate lower body exercises and strength training while safely remaining on the treadmill. What has been further needed is a plurality of exercise programs that are configured to incorporate the use of both the treadmill and the plurality of resistance bands by a user.

FIELD OF THE INVENTION

The present invention relates to treadmills, and more particularly, to a multiuse treadmill apparatus comprising a treadmill, a support structure, a plurality of hooks, and a pair of weight sensors.

SUMMARY OF THE INVENTION

The general purpose of the present multiuse treadmill apparatus, described subsequently in greater detail, is to provide a treadmill which has many novel features that result in a multiuse treadmill apparatus which is not anticipated, rendered obvious, suggested, or even implied by prior art, either alone or in combination thereof.

To accomplish this, the present multiuse treadmill apparatus comprises a treadmill having a running deck, a belt, a motor, an activation switch, a microprocessor, a front side, a back side, a left deck, and a right deck. Each of the left deck and the right deck has a left side and a right side. The width of the right deck and the left deck is at least three feet.

A support structure further comprises a right pole and a left pole. Each of the right pole and the left pole has a top support and a bottom support. Each of the top support and the bottom support has a bottom surface, a top surface, an exterior surface, an upper half, and a lower half. The bottom surface of the bottom support of the right pole is disposed on the left side of the right deck and the bottom surface of the bottom support of the left pole is disposed on the right side of the left deck. The bottom support of the right pole and the bottom support of the left pole are telescopic supports that are configured to be lockable at a selected height. The support structure further comprises a pair of handles having a right handle and a left handle. Each of the right handle and the left handle has a front surface, a rear surface, and an external surface. The right handle front surface and the left handle front surface are perpendicularly disposed on the top support upper half of the right pole and the top support upper half of the left pole, respectively. The rear surface of the right handle and the rear surface of the left handle are disposed toward the back side of the treadmill. A grip material can optionally be disposed on the external surface of each of the pair of handles. The grip material is optionally a rubber. The support structure further comprises a control panel having a top side, a bottom side, a right edge, and a left edge. The control panel is continuously disposed between the top surface of the right pole upper half and the top surface of the ii left pole upper half. A display screen is disposed on the control panel, and a plurality of controls is disposed on the control panel. A pair of support frames comprises a right support frame and a left support frame. Each of the right support frame and the left support frame has a rear pole and a front pole. Each of the rear pole and the front pole has a top end and a bottom end. The bottom end of the rear pole of the right support frame is disposed on the right edge of the control panel top side, and the bottom end of the rear pole of the left support frame is disposed on the left edge of the control panel top side. The rear pole of the right support frame, the bottom support of the right pole, and the top support of the right pole are colinearly disposed with each other. The rear pole of the left support frame, the bottom support of the left pole, and the top support of the left pole are colinearly disposed with each other. The bottom end of the front pole of the right support frame is disposed on the bottom end of the rear pole of the right support frame. The bottom end of the front pole of the left support frame is disposed on the bottom end of the rear pole of the left support frame. The front pole of the right support frame and the front pole of the left support frame are disposed at an acute angle from the rear pole of the right support frame and the rear pole of the left support frame, respectively, towards the treadmill back side. Lastly, the support structure further comprises a pair of top support bars and a pair of bottom support bars. The pair of top support bars comprises a rear support bar and a forward support bar. The rear support bar is perpendicularly disposed between the rear pole top end of the left support frame and the rear pole top end of the right support frame. The forward support bar is perpendicularly disposed between the front pole top end of the left support frame and the front pole top end of the right support frame. The pair of bottom support bars comprises a lower support bar and an upper support bar. The lower support bar is perpendicularly disposed between the lower half of the left pole bottom support and the lower half of the right pole bottom support. The upper support bar is perpendicularly disposed between the rear pole of the right support frame and the rear pole of the left support frame.

A plurality of hooks are continuously disposed on at least one of the front pole of the right support frame, the front pole of the left support frame, the pair of bottom support bars, and the pair of top support bars. Each of the plurality of hooks has an apex perpendicularly disposed towards the back side of the treadmill. The plurality of hooks are configured to engage a plurality of resistance bands. The multiuse treadmill apparatus further comprises a pair of weight sensors having a right weight sensor and a left weight sensor. The right weight sensor and the left weight sensor are centrally disposed within the right deck and the left deck, respectively. The motor, the activation switch, the microprocessor, the control panel, the display screen, the pair of weight sensors, and the belt are in operational communication with each other. The motor has an on position and an alternate off position. The motor is in the on position when the belt is moving. The motor is in the off position when the belt is not moving. The right weight sensor and the left weight sensor are configured to turn the motor off when a minimum weight is downwardly applied to the right deck and the left deck, respectively. The minimum weight can optionally be twenty-five pounds.

The multiuse treadmill apparatus can optionally further comprise a plurality of exercise programs stored within the microprocessor. The plurality of exercise programs is configured to be selectable by a user through the plurality of controls on the control panel and viewable on the display screen. The plurality of exercise programs is configured to incorporate the use of the treadmill and the plurality of resistance bands by the user.

Thus has been broadly outlined the more important features of the present multiuse treadmill apparatus so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
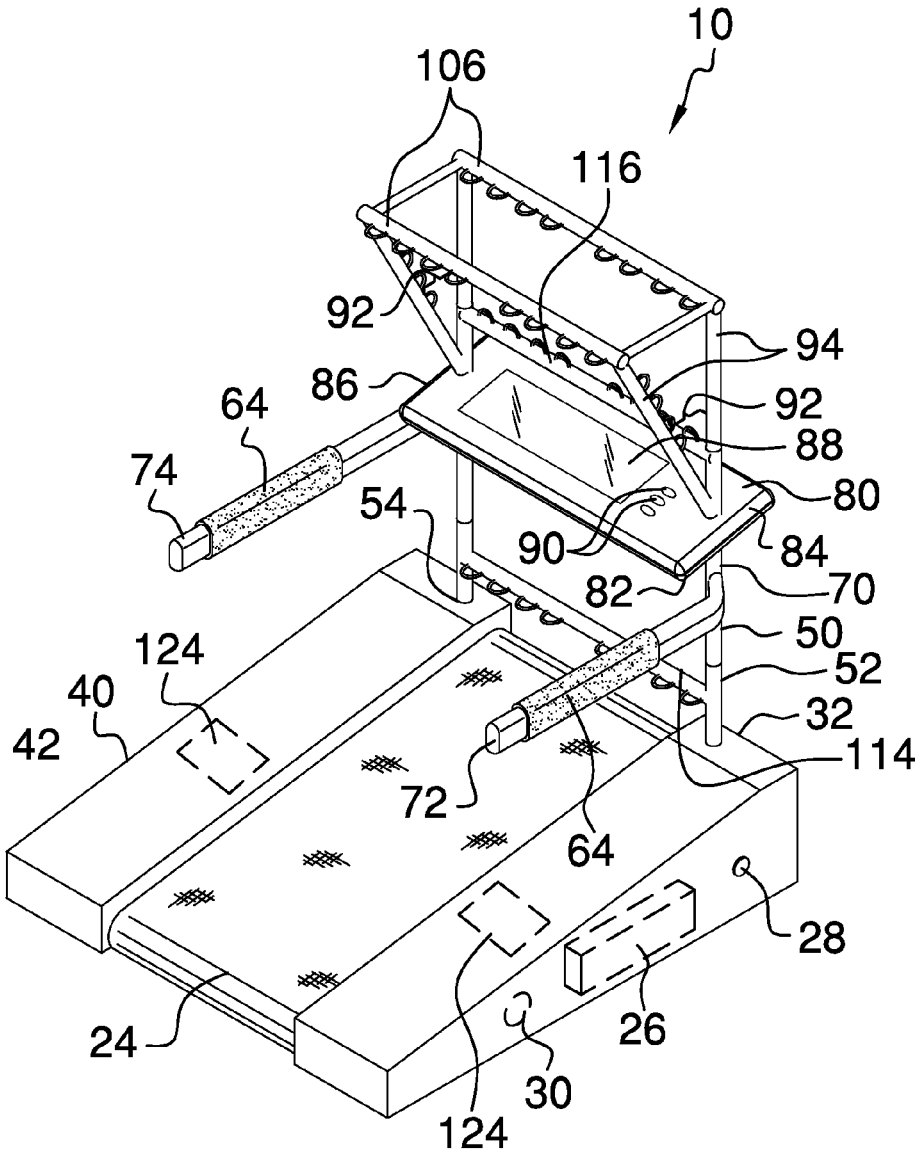
FIG. 1 is a rear isometric view.
Figure 2:
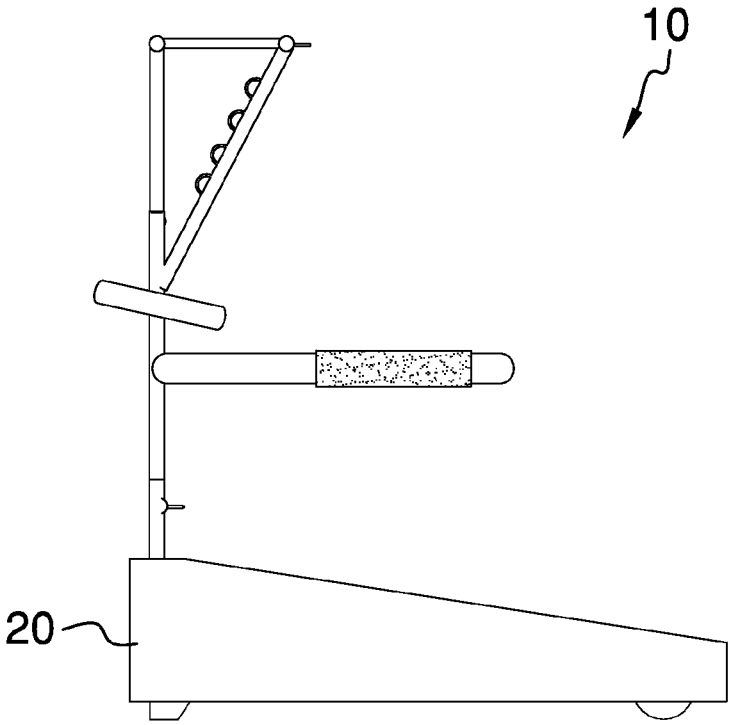
FIG. 2 is a left side elevation view.
Figure 3:
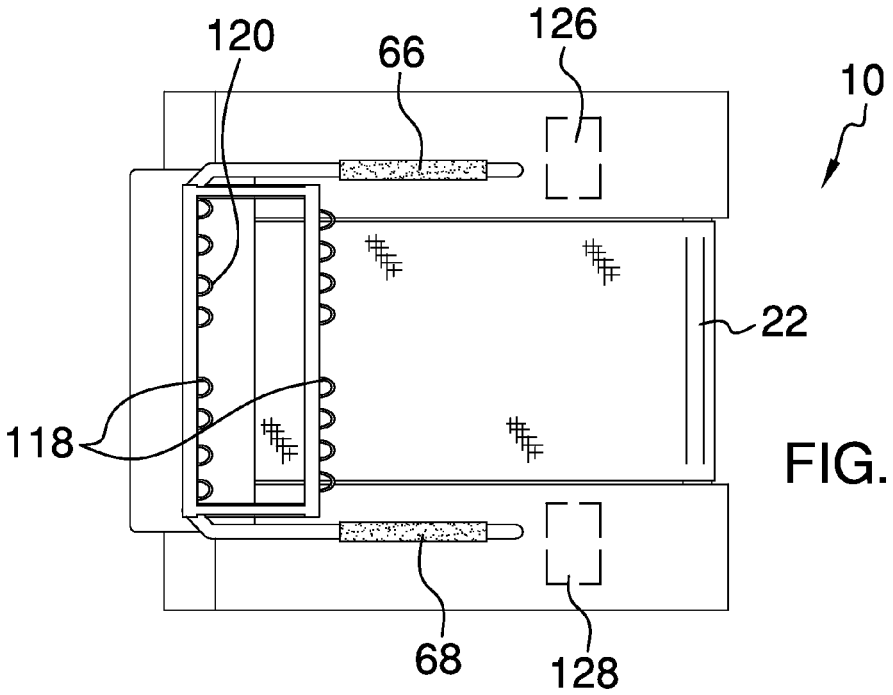
FIG. 3 is a top plan view.
Figure 4:
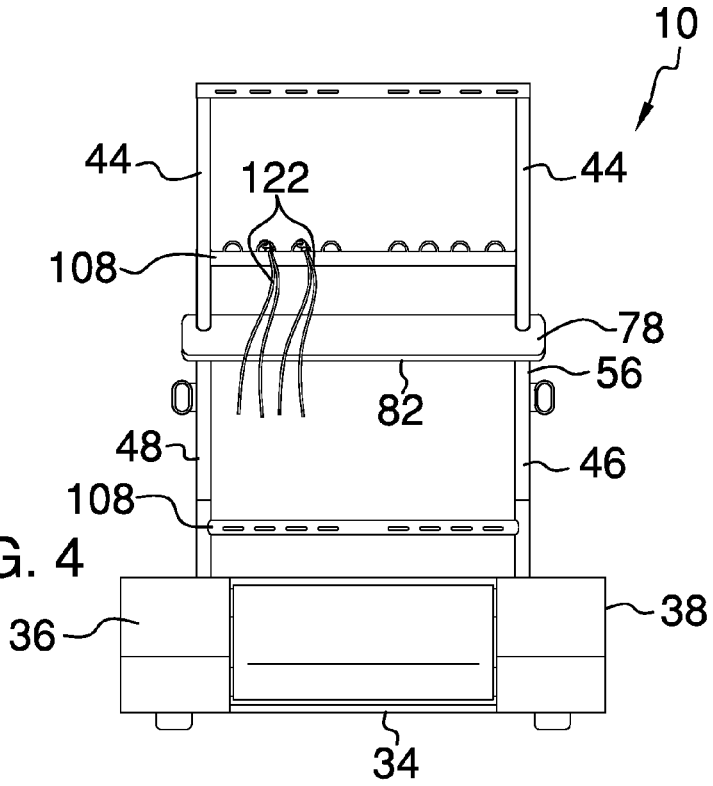
FIG. 4 is a rear elevation view.
Figure 5:
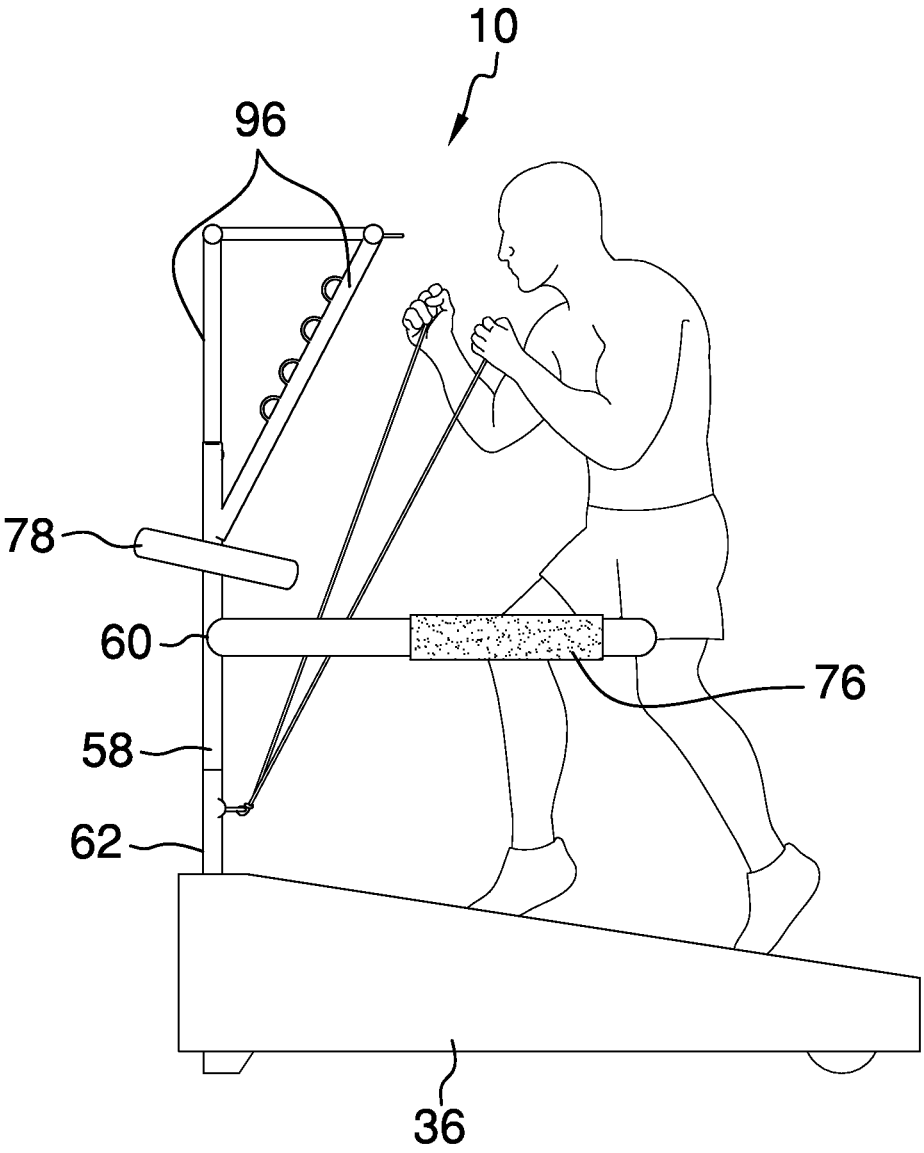
FIG. 5 is an in use view showing a plurality of hooks and a user utilizing one of a plurality of resistance bands to perform a bicep curl.
Figure 6:
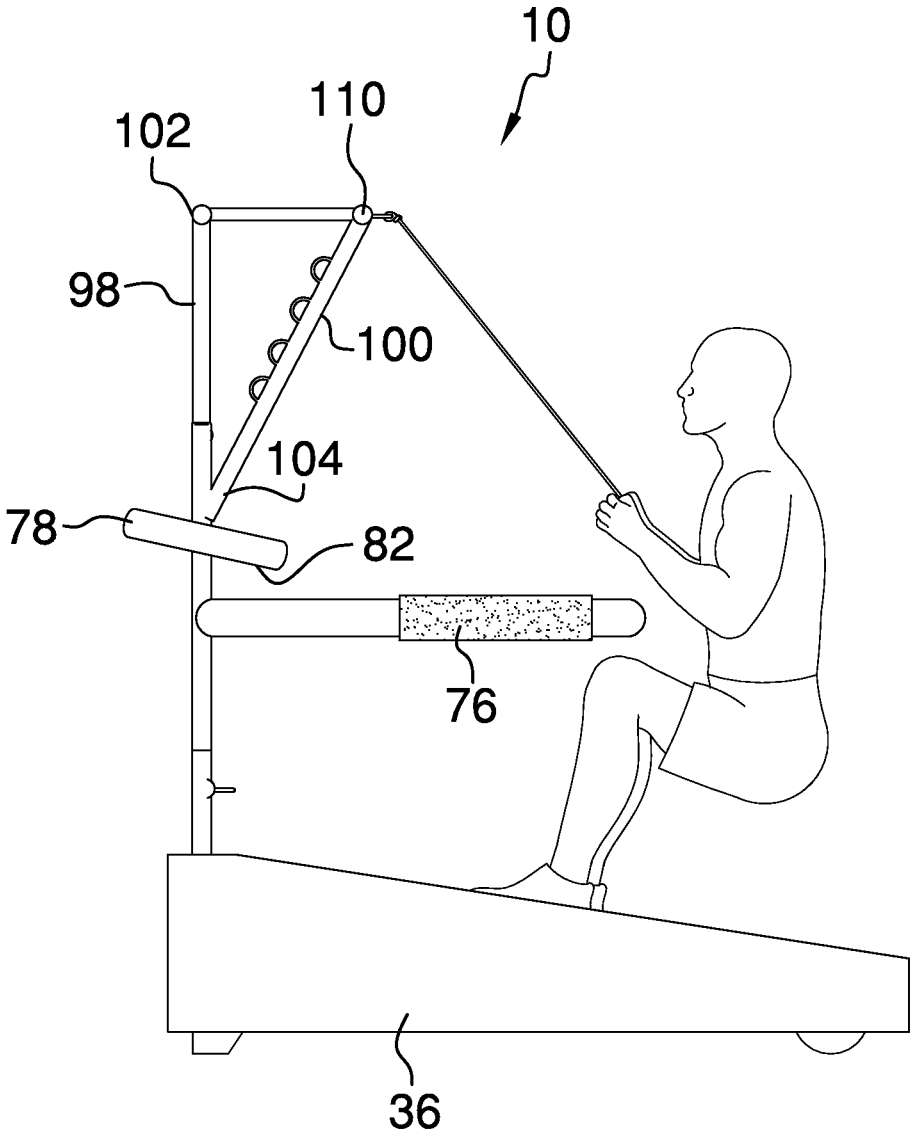
FIG. 6 is an in use view showing the plurality of hooks and the user utilizing one of the plurality of resistance bands to perform a squat.
Figure 7:
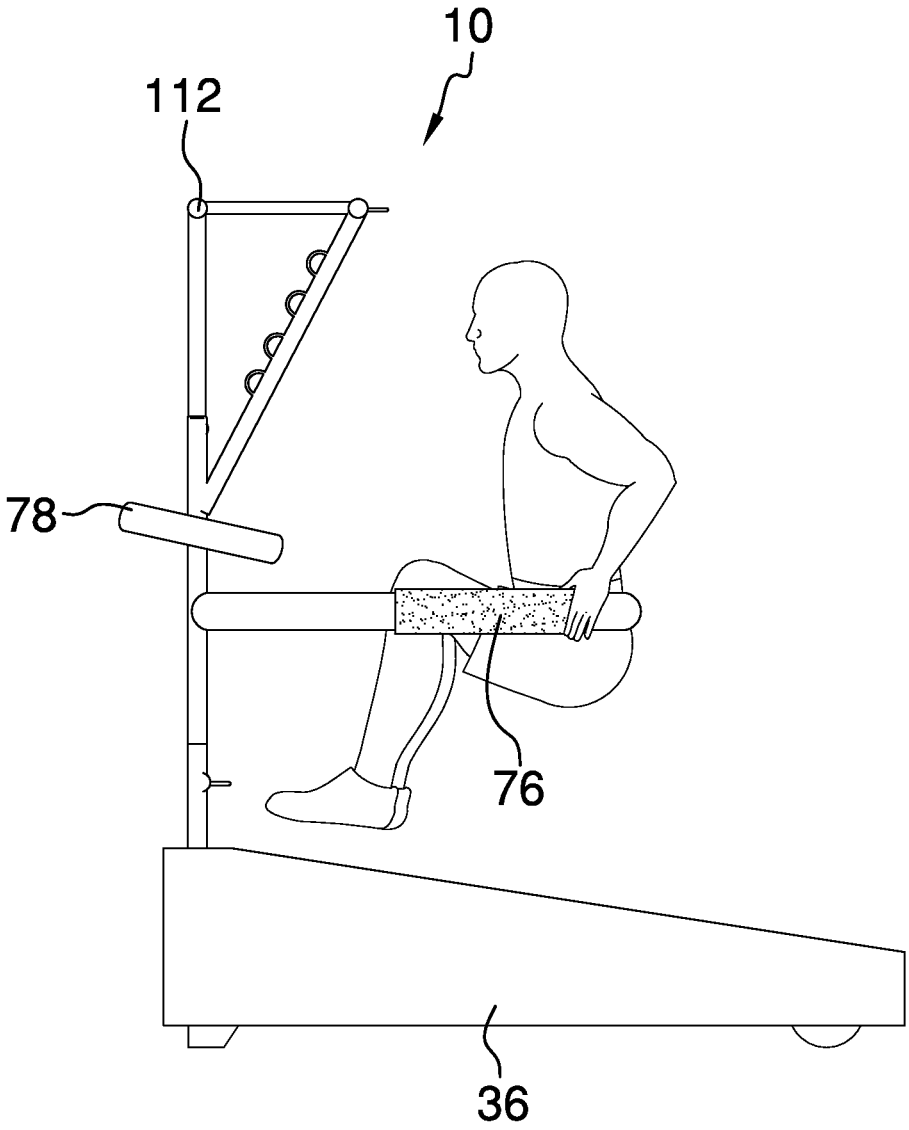
FIG. 7 is an in-use view showing a grip material and the user utilizing the pair of handles to perform a tricep dip.

With reference now to the drawings, and in particular FIGS. 1 through 8 thereof, an example of the instant multiuse treadmill apparatus employing the principles and concepts of the present multiuse treadmill apparatus and generally designated by the reference number 10 will be described.

Referring to FIGS. 1 through 8, the present multiuse treadmill apparatus 10 is illustrated. The multiuse treadmill apparatus 10 comprises a treadmill 20 having a running deck 22, a belt 24, a motor 26, an activation switch 28, a microprocessor 30, a front side 32, a back side 34, a left deck 36, and a right deck 38. Each of the left deck 36 and the right deck 38 has a left side 40 and a right side 42. The width of the right deck 38 and the left deck 36 is at least three feet.

A support structure 44 further comprises a right pole 46 and a left pole 48. Each of the right pole 46 and the left pole 48 has a top support 50 and a bottom support 52. Each of the top support 50 and the bottom support 52 has a bottom surface 54, a top surface 56, an exterior surface 58, an upper half 60, and a lower half 62. The bottom surface 54 of the bottom support 52 of the right pole 46 is disposed on the left side 40 of the right deck 38, and the bottom surface 54 of the bottom support 52 of the left pole 48 is disposed on the right side 42 of the left deck 36. The bottom support 52 of the right pole 46 and the bottom support 52 of the left pole 48 are telescopic supports that are configured to be lockable at a selected height. The support structure 44 further comprises a pair of handles 64 having a right handle 66 and a left handle 68. Each of the right handle 66 and the left handle 68 has a front surface 70, a rear surface 72, and an external surface 74. The front surface 70 of the right handle 66 and the front surface 70 of the left handle 68 are perpendicularly disposed on the top support 50 upper half 60 of the right pole 46 and the top support 50 upper half 60 of the left pole 48, respectively. The rear surface 72 of the right handle 66 and the rear surface 72 of the left handle 68 are disposed toward the back side 34 of the treadmill 20. A grip material 76 can optionally be disposed on the external surface 74 of each of the pair of handles 64. The support structure 44 further comprises a control panel 78 having a top side 80, a bottom side 82, a right edge 84, and a left edge 86. The control panel 78 is continuously disposed between the top surface 56 of the right pole 46 upper half 60 and the top surface 56 of the left pole 48 upper half 60. A display screen 88 is disposed on the control panel 78, and a plurality of controls 90 is disposed on the control panel 78. A pair of support frames 92 comprises a right support frame 94 and a left support frame 96. Each of the right support frame 94 and the left support frame 96 has a rear pole 98 and a front pole 100. Each of the rear pole 98 and the front pole 100 has a top end 102 and a bottom end 104. The bottom end 104 of the rear pole 98 of the right support frame 94 is disposed on the right edge 84 of the control panel top side 80, and the bottom end 104 of the rear pole 98 of the left support frame 96 is disposed on the left edge 86 of the control panel top side 80. The rear pole 98 of the right support frame 94, the bottom support 52 of the right pole 46, and the top support 50 of the right pole 46 are colinearly disposed with each other. The rear pole 98 of the left support frame 96, the bottom support 52 of the left pole 48, and the top support 50 of the left pole 48 are colinearly disposed with each other. The bottom end 104 of the front pole 100 of the right support frame 94 is disposed on the bottom end 104 of the rear pole 98 of the right support frame 94. The bottom end 104 of the front pole 100 of the left support frame 96 is disposed on the bottom end 104 of the rear pole 98 of the left support frame 96. Lastly, the support structure 44 further comprises a pair of top support bars 106 and a pair of bottom support bars 108. The pair of top support bars 106 comprises a rear support bar 110 and a forward support bar 112. The rear support bar 110 is perpendicularly disposed between the top end 102 of the rear pole 98 of the left support frame 96 and the top end 102 of the rear pole 98 of the right support frame 94. The forward support bar 112 is perpendicularly disposed between the top end 102 of the front pole 100 of the left support frame 96 and the top end 102 of the front pole 100 of the right support frame 94. The pair of bottom support bars 108 comprises a lower support bar 114 and an upper support bar 116. The lower support bar 114 is perpendicularly disposed between the lower half 62 of the left pole bottom support 52 and the lower half 62 of the right pole bottom support 52. The upper support bar 116 is perpendicularly disposed between the rear pole 98 of the right support frame 94 and the rear pole 98 of the left support frame 96.

Figure 8:
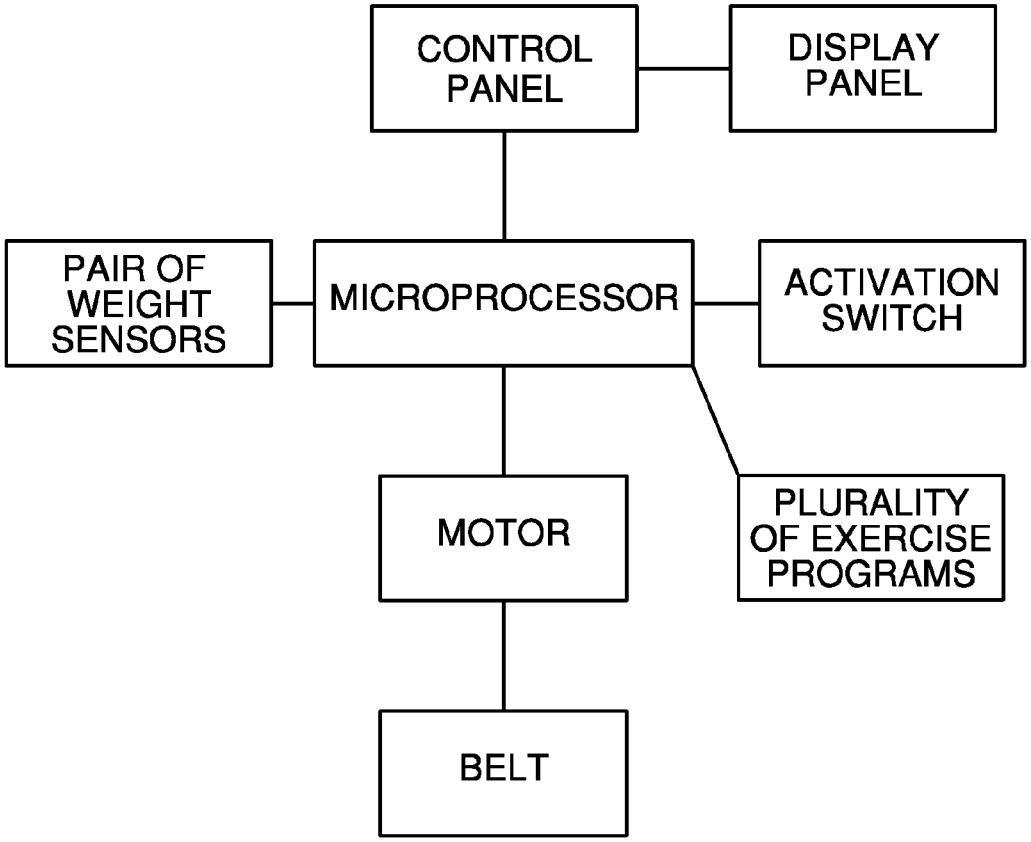
FIG. 8 is a block diagram showing a control panel, a microprocessor, a motor, a belt, a pair of weight sensors, a display screen, an activation switch, and a plurality of exercise programs in operational communication with each other.

A plurality of hooks 118 are continuously disposed on at least one of the front pole 100 of the right support frame 94, the front pole 100 of the left support frame 96, the pair of bottom support bars 108, and the pair of top support bars 106. Each of the plurality of hooks 118 has an apex 120 perpendicularly disposed towards the back side 34 of the treadmill 20. The plurality of hooks 118 are configured to engage a plurality of resistance bands 122. The multiuse treadmill apparatus 10 further comprises a pair of weight sensors 124 having a right weight sensor 126 and a left weight sensor 128. The right weight sensor 126 and the left weight sensor 128 are centrally disposed within the right deck 38 and the left deck 36, respectively. As best shown in FIG. 8, the motor 26, the activation switch 28, the microprocessor 30, the control panel 78, the display screen 88, the pair of weight sensors 124, and the belt 24 are in operational communication with each other.

What is claimed is:

1. A multiuse treadmill apparatus comprising:

a treadmill having a running deck, a belt, a motor, an activation switch, a microprocessor, a front side, a back side, a left deck and a right deck, each of the left deck and the right deck having a left side and a right side;

wherein the width of the right deck and the left deck is at least three feet;

a support structure further comprising:

a right pole and a left pole, each of the right pole and the left pole having a top support and a bottom support, each of the top support and the bottom support having a bottom surface, a top surface, an exterior surface, an upper half, and a lower half;

wherein the bottom surface of the right pole bottom support is disposed on the right deck left side and the bottom surface of the left pole bottom support is disposed on the left deck right side;

wherein the right pole bottom support and the left pole bottom support are telescopic supports;

wherein the right pole bottom support and the left pole bottom support are configured to be lockable at a selected height;

a pair of handles comprising a right handle and a left handle, each of the right handle and the left handle having a front surface, a rear surface, and an external surface;

wherein the right handle front surface is perpendicularly disposed on the top support upper half of the right pole and the right handle rear surface is disposed towards the treadmill back side;

wherein the left handle front surface is perpendicularly disposed on the top support upper half of the left pole and the left handle rear surface is disposed towards the treadmill back side;

a control panel having a top side, a bottom side, a right edge, and a left edge, wherein the control panel bottom side is continuously disposed between the top surface of the right pole upper half and the top surface of the left pole upper half;

a display screen disposed on the control panel;

a plurality of controls disposed on the control panel;

a pair of support frames comprising a right support frame and a left support frame, each of the right support frame and the left support frame having a rear pole and a front pole;

wherein each of the rear pole and the front pole has a top end and a bottom end;

wherein the rear pole bottom end of the right support frame is disposed on the right edge of the control panel top side and the rear pole bottom end of the left support frame is disposed on the left edge of the control panel top side;

wherein the rear pole right support frame, the right pole bottom support, and the right pole top support are colinearly disposed with each other;

wherein the rear pole left support frame, the left pole bottom support, and the left pole top support are colinearly disposed with each other;

wherein the front pole bottom end of the right support frame is disposed on the rear pole bottom end of the right support frame;

wherein the front pole bottom end of the left support frame is disposed on the rear pole bottom end of the left support frame;

wherein the front pole of the right support frame and the front pole of the left support frame are disposed at an acute angle from the rear pole of the right support frame and the rear pole of the left support frame, respectively, towards the treadmill back side;

a pair of top support bars comprising a rear support bar and a forward support bar;

wherein the rear support bar is perpendicularly disposed between the rear pole top end of the left support frame and the rear pole top end of the right support frame;

wherein the forward support bar is perpendicularly disposed between the front pole top end of the left support frame and the front pole top end of the right support frame;

a pair of bottom support bars comprising a lower support bar and an upper support bar;

wherein the lower support bar is perpendicularly disposed between the lower half of the left pole bottom support and the lower half of the right pole bottom support;

wherein the upper support bar is perpendicularly disposed between the rear pole of the right support frame and the rear pole of the left support frame;

a plurality of hooks continuously disposed on at least one of the front pole of the right support frame, the front pole of the left support frame, the pair of bottom support bars, and the pair of top support bars;

wherein each of the plurality of hooks has an apex perpendicularly disposed towards the treadmill back side;

wherein the plurality of hooks are configured to engage a plurality of resistance bands; and a pair of weight sensors comprising a right weight sensor and a left weight sensor;

wherein the right weight sensor is centrally disposed within the right deck;

wherein the left weight sensor is centrally disposed within the left deck;

wherein the motor, the activation switch, the microprocessor, the control panel, the display screen, the pair of weight sensors, and the belt are in operational communication with each other;

wherein the motor has an on position and an alternate off position;

wherein the motor is in the on position when the belt is moving;

wherein the motor is in the off position when the belt is not moving;

wherein the right weight sensor is configured to turn the motor off when a minimum weight is downwardly applied to the right deck;

wherein the left weight sensor is configured to turn the motor off when the minimum weight is downwardly applied to the left deck.

2. The multiuse treadmill apparatus of claim 1 further comprising:

a plurality of exercise programs stored within the microprocessor, wherein the plurality of exercise programs is configured to be selectable by a user through the plurality of controls on the control panel and viewable on the display screen;

wherein the plurality of exercise programs is configured to incorporate the use of the treadmill and the plurality of resistance bands by the user.

3. The multiuse treadmill apparatus of claim 1 further comprising a grip material disposed on the external surface of each of the pair of handles.

4. The multiuse treadmill apparatus of claim 3 wherein the grip material is a rubber.

5. A multiuse treadmill apparatus comprising:

a treadmill having a running deck, a belt, a motor, an activation switch, a microprocessor, a front side, a back side, a left deck and a right deck, each of the left deck and the right deck having a left side and a right side;

wherein the width of the right deck and the left deck is at least three feet;

a support structure further comprising:

a right pole and a left pole, each of the right pole and the left pole having a top support and a bottom support, each of the top support and the bottom support having a bottom surface, a top surface, an exterior surface, an upper half, and a lower half;

wherein the bottom surface of the right pole bottom support is disposed on the right deck left side and the bottom surface of the left pole bottom support is disposed on the left deck right side;

wherein the right pole bottom support and the left pole bottom support are telescopic supports;

wherein the right pole bottom support and the left pole bottom support are configured to be lockable at a selected height;

a pair of handles comprising a right handle and a left handle, each of the right handle and the left handle having a front surface, a rear surface, and an external surface;

wherein the right handle front surface is perpendicularly disposed on the top support upper half of the right pole and the right handle rear surface is disposed towards the treadmill back side;

wherein the left handle front surface is perpendicularly disposed on the top support upper half of the left pole and the left handle rear surface is disposed towards the treadmill back side;

a grip material disposed on the external surface of each of the pair of handles;

wherein the grip material is a rubber;

a control panel having a top side, a bottom side, a right edge, and a left edge, wherein the control panel bottom side is continuously disposed between the top surface of the right pole upper half and the top surface of the left pole upper half;

a display screen disposed on the control panel;

a plurality of controls disposed on the control panel;

a pair of support frames comprising a right support frame and a left support frame, each of the right support frame and the left support frame having a rear pole and a front pole;

wherein each of the rear pole and the front pole has a top end and a bottom end;

wherein the rear pole bottom end of the right support frame is disposed on the right edge of the control panel top side and the rear pole bottom end of the left support frame is disposed on the left edge of the control panel top side;

wherein the rear pole right support frame, the right pole bottom support, and the right pole top support are colinearly disposed with each other;

wherein the rear pole left support frame, the left pole bottom support, and the left pole top support are colinearly disposed with each other;

wherein the front pole bottom end of the right support frame is disposed on the rear pole bottom end of the right support frame;

wherein the front pole bottom end of the left support frame is disposed on the rear pole bottom end of the left support frame;

wherein the front pole of the right support frame and the front pole of the left support frame are disposed at an acute angle from the rear pole of the right support frame and the rear pole of the left support frame, respectively, towards the treadmill back side;

a pair of top support bars comprising a rear support bar and a forward support bar;

wherein the rear support bar is perpendicularly disposed between the rear pole top end of the left support frame and the rear pole top end of the right support frame;

wherein the forward support bar is perpendicularly disposed between the front pole top end of the left support frame and the front pole top end of the right support frame;

a pair of bottom support bars comprising a lower support bar and an upper support bar;

wherein the lower support bar is perpendicularly disposed between the lower half of the left pole bottom support and the lower half of the right pole bottom support;

wherein the upper support bar is perpendicularly disposed between the rear pole of the right support frame and the rear pole of the left support frame;

a plurality of hooks continuously disposed on at least one of the front pole of the right support frame, the front pole of the left support frame, the pair of bottom support bars, and the pair of top support bars;

wherein each of the plurality of hooks has an apex perpendicularly disposed towards the treadmill back side;

wherein the plurality of hooks are configured to engage a plurality of resistance bands;

a pair of weight sensors comprising a right weight sensor and a left weight sensor;

wherein the right weight sensor is centrally disposed within the right deck;

wherein the left weight sensor is centrally disposed within the left deck;

wherein the motor, the activation switch, the microprocessor, the control panel, the display screen, the pair of weight sensors, and the belt are in operational communication with each other;

wherein the motor has an on position and an alternate off position;

wherein the motor is in the on position when the belt is moving;

wherein the motor is in the off position when the belt is not moving;

wherein the right weight sensor is configured to turn the motor off when a minimum weight is downwardly applied to the right deck;

wherein the left weight sensor is configured to turn the motor off when the minimum weight is downwardly applied to the left deck; and a plurality of exercise programs stored within the microprocessor, wherein the plurality of exercise programs is configured to be selectable by a user through the plurality of controls on the control panel and viewable on the display screen;

wherein the plurality of exercise programs is configured to incorporate the use of the treadmill and the plurality of resistance bands by the user.

* * * * *